United States Patent [19]

Vann

[11] 4,078,611

[45] Mar. 14, 1978

[54] HIGH TEMPERATURE PERFORATING METHOD

[76] Inventor: Roy R. Vann, Box 38, Artesia, N. Mex. 88210

[21] Appl. No.: 739,128

[22] Filed: Nov. 5, 1976

Related U.S. Application Data

[60] Continuation-in-part of Ser. No. 622,427, Oct. 14, 1975, Pat. No. 3,990,507, which is a division of Ser. No. 522,529, Nov. 11, 1974, Pat. No. 3,912,013.

[51] Int. Cl.[2] ..... E21B 29/00

[52] U.S. Cl. ..... 166/297; 175/4.56

[58] Field of Search ..... 175/4.56; 166/55.1, 166/63, 297; 102/20

[56] References Cited

U.S. PATENT DOCUMENTS

| | | | |
|---|---|---|---|
| 2,866,508 | 12/1958 | Church | 166/55.1 X |
| 2,974,739 | 3/1961 | Dean | 175/4.56 |
| 3,058,523 | 10/1962 | McElheny | 166/55.1 X |
| 3,190,372 | 6/1965 | Johnson | 102/20 X |
| 3,193,013 | 7/1965 | Whiteside | 166/63 X |
| 3,199,287 | 8/1965 | Kinley | 166/63 X |
| 3,530,948 | 9/1970 | Garrett | 166/55.1 X |
| 3,706,340 | 12/1972 | Shuster | 166/297 |
| 3,706,344 | 12/1972 | Vann | 166/297 |
| 3,957,115 | 5/1976 | Kerzee et al. | 166/297 |

*Primary Examiner*—Ernest R. Purser

*Assistant Examiner*—Richard E. Favreau

*Attorney, Agent, or Firm*—Marcus L. Bates

[57] ABSTRACT

A perforating gun apparatus is suspended downhole in a relatively cool zone of a borehole by connecting the gun to a tubing string. The tubing string includes a wireline operated, releasable coupling interposed therein. A packer device is attached to the tubing string uphole of the releasable coupling.

An abutment means is positioned downhole within a relatively high temperature zone and in close proximity to a hydrocarbon bearing formation. The abutment means includes a latch means by which the gun and abutment means are attached to one another.

The releasable coupling is actuated, whereupon the gun is released and falls downhole, where it is arrested by the abutment means. The gun is latched to the abutment means, while the force of the impact detonates the gun, thereby perforating a high temperature zone of the wellbore.

A wireline fishing tool is run through the tubing and downhole into engagement with the released part of the coupling member. The engaged released part of the coupling member, detonated gun, and the abutment means are lifted and thereafter the entire apparatus is repositioned further downhole in the borehole.

12 Claims, 10 Drawing Figures

20
19
V
H
22
18
12
14
10
25
11
24
16
26
28
27
29
17
30
33
32
32'
39
40
38
35
48
34
36
27'
41
42

FIG. 5
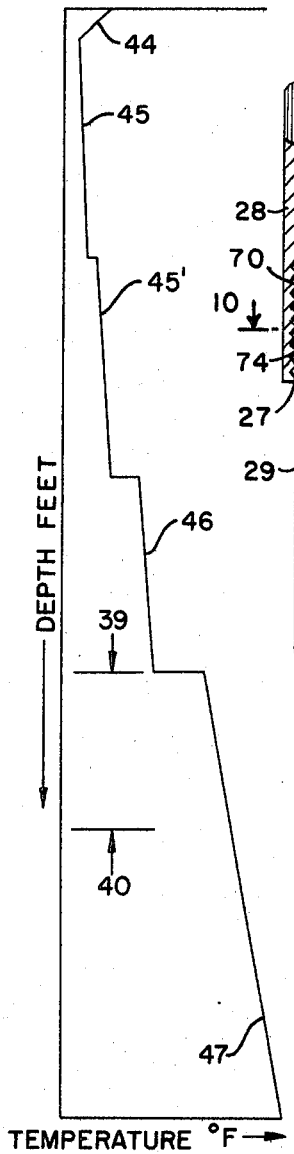
FIG. 9
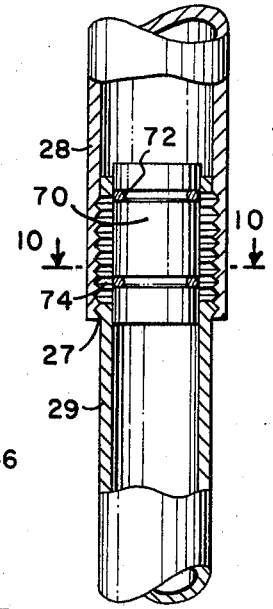
FIG. 6
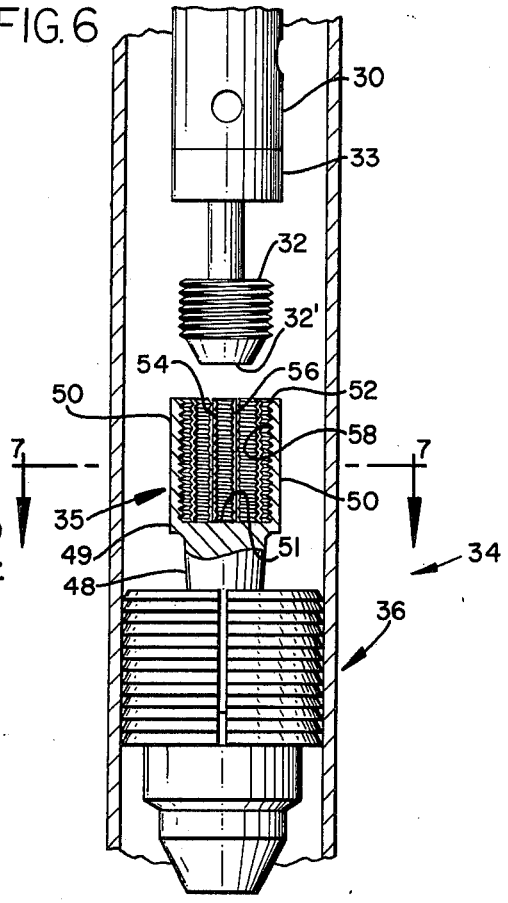
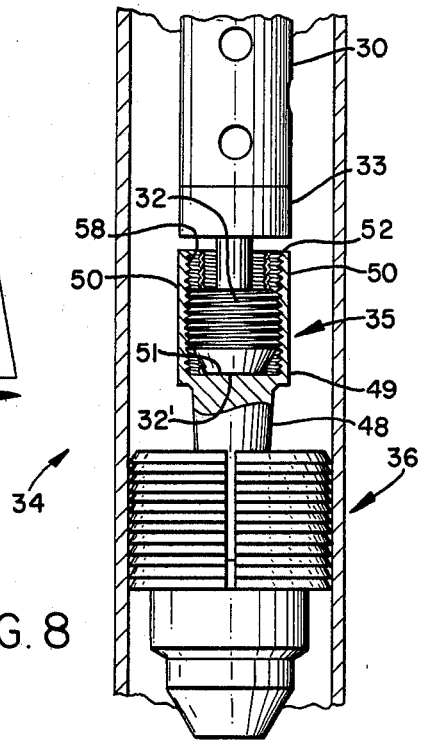
FIG. 8
FIG. 7
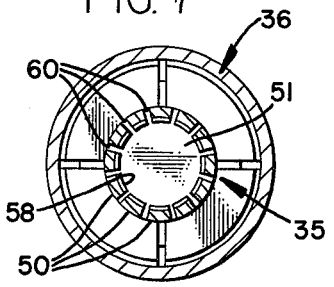
FIG. 10
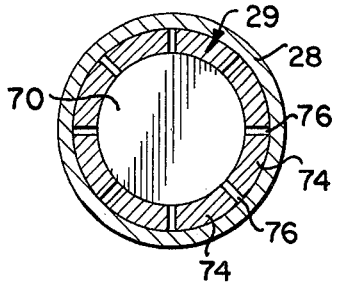

HIGH TEMPERATURE PERFORATING METHOD

REFERENCE TO RELATED PATENT APPLICATIONS

The instant application is a continuation-in-part of my copending application Ser. No. 622,427 filed Oct. 14, 1975, entitled "HIGH TEMPERATURE PERFORATING APPARATUS", which will issue as U.S. Pat. No. 3,990,507 on Nov. 9, 1976, which is a division of application Ser. No. 522,529 filed Nov. 11, 1974, now Pat. No. 3,912,013, issued Oct. 14, 1975.

BACKGROUND OF THE INVENTION

My previously issued U.S. Pat. No. 3,706,344 teaches the desirability of permanently completing a well in such a manner that the well can be open flowed the instant the production zone is perforated.

My U.S. Pat. Nos. 3,912,013 and 3,990,507 teach a method by which a high temperature hydrocarbon producing zone can be perforated while utilizing the tubing conveyed, permanent completion apparatus of my U.S. Pat. No. 3,706,344.

My above mentioned U.S. Pat. No. 3,912,013 also teaches a jet perforating gun which is detonated upon impact with an abutment means. My U.S. Pat. No. 3,966,236 and patent application Ser. No. 691,384, filed June 1, 1976, teach a wireline actuated, releasable coupling means which can be used to advantage in carrying out the present completion techniques.

Some high temperature, hydrocarbon producing formations exhibit a tremendous flow of high pressure gases; and accordingly, as soon as the hydrocarbon bearing zone is perforated, there is sufficient upthrust to carry the perforating gun back uphole, thereby causing considerable damage. This is especially so when the well is completed utilizing the techniques set forth in my Pat. No. 3,912,013. Accordingly, it is desirable to be able to complete a high temperature zone of a well in the above described manner and at the same time, prevent upthrust of the perforating gun when the gun is initially detonated. Moreover, it is desirable to be able to subsequently reposition the gun at a lower elevation in the borehole to thereby gain access to the production zone, as well as to other lower producing formations, at some subsequent time.

SUMMARY OF THE INVENTION

This invention specifically relates to a method of completing a hydrocarbon containing formation located downhole in a borehole within a high temperature zone which underlies a relatively low temperature zone. The method is realized by suspending a perforating gun apparatus from a releasable coupling and locating the gun within the low temperature zone of the borehole. An abutment means is positioned downhole within the high temperature zone of the borehole in close proximity of a hydrocarbon containing formation.

The abutment means is adapted to arrest the perforating gun when the gun is released and dropped. The abutment means is a wireline settable device and can be repositioned downhole within the borehole as may be desired.

The gun apparatus is released by actuating the releasable coupling, whereupon the gun is dropped and falls downhole from the low to the high temperature zone, thereby impacting against the abutment means. The gun and abutment means include a latch means by which the two are connected together when the gun impacts against the abutment means.

The gun includes detonating means by which the perforating charges are fired in response to the gun impacting against the abutment means. Accordingly, when the gun strikes the abutment means, the gun is latched onto the abutment means simultaneously while the charges thereof are discharged.

After the gun and abutment means are latched to one another, the gun has been discharged, and the well is producing; a wireline fishing tool is run downhole into engagement with the released part of the releasable coupling. The wireline is utilized to reposition or reset the lower string which includes the abutment means so that the apparatus can be lowered further downhole away from the production zone.

In carrying out the above method of this invention, a releasable coupling and a packer means is attached to a tubing string with the gun underlying the releasable coupling and the packer means being located uphole of the releasable coupling. A wireline fishing tool is run downhole and the releasable coupling actuated, thereby parting the tubing string and permitting the gun to fall downhole, where it impacts the abutment means.

Therefore, a primary object of the present invention is the provision of both method and apparatus by which a high temperature zone in a borehole can be successfully perforated.

Another object of the invention is to provide a novel system by which conventional perforating guns can be used to perforate a high temperature zone of a borehole.

A further object of this invention is to disclose and provide improvements in the art of perforating a high temperature zone of a borehole.

A still further object of this invention is to provide improvements in well completion techniques.

Another and still further object of this invention is the provision of a new combination of elements which enables employment of conventional perforating guns downhole in a high temperature region of a borehole which is at a temperature in excess of the designed operating temperature of other perforating gun apparatus.

An additional object of the present invention is to disclose and provide a wireline operated system of perforating a high temperature region of a borehole.

These and various other objects and advantages of the invention will become readily apparent to those skilled in the art upon reading the following detailed description and claims and by referring to the accompanying drawings.

The above objects are attained in accordance with the present invention by the provision of a method of perforating a high temperature region of a borehole for use with apparatus fabricated in a manner substantially as described in the above abstract and summary.

BRIEF DESCRIPTION OF THE DRAWINGS

FIG. 5 is a hypothetical plot of temperature versus borehole depth;

FIG. 6 is an enlarged, fragmented, part cross-sectional view of part of the apparatus disclosed in some of the foregoing figures;

FIG. 7 is a part cross-sectional view taken along line 7—7 of FIG. 6; and

FIG. 8 is a part cross-sectional view which discloses the apparatus of FIG. 6 as being in the alternate configuration.

FIG. 9 is a cross-sectional view of one embodiment of a releasable coupling apparatus made in accordance with the present invention;

FIG. 10 is a cross-sectional view taken along line 10—10 of FIG. 9.

DETAILED DESCRIPTION OF THE PREFERRED EMBODIMENT

Figures 1, 2, 3, 4:
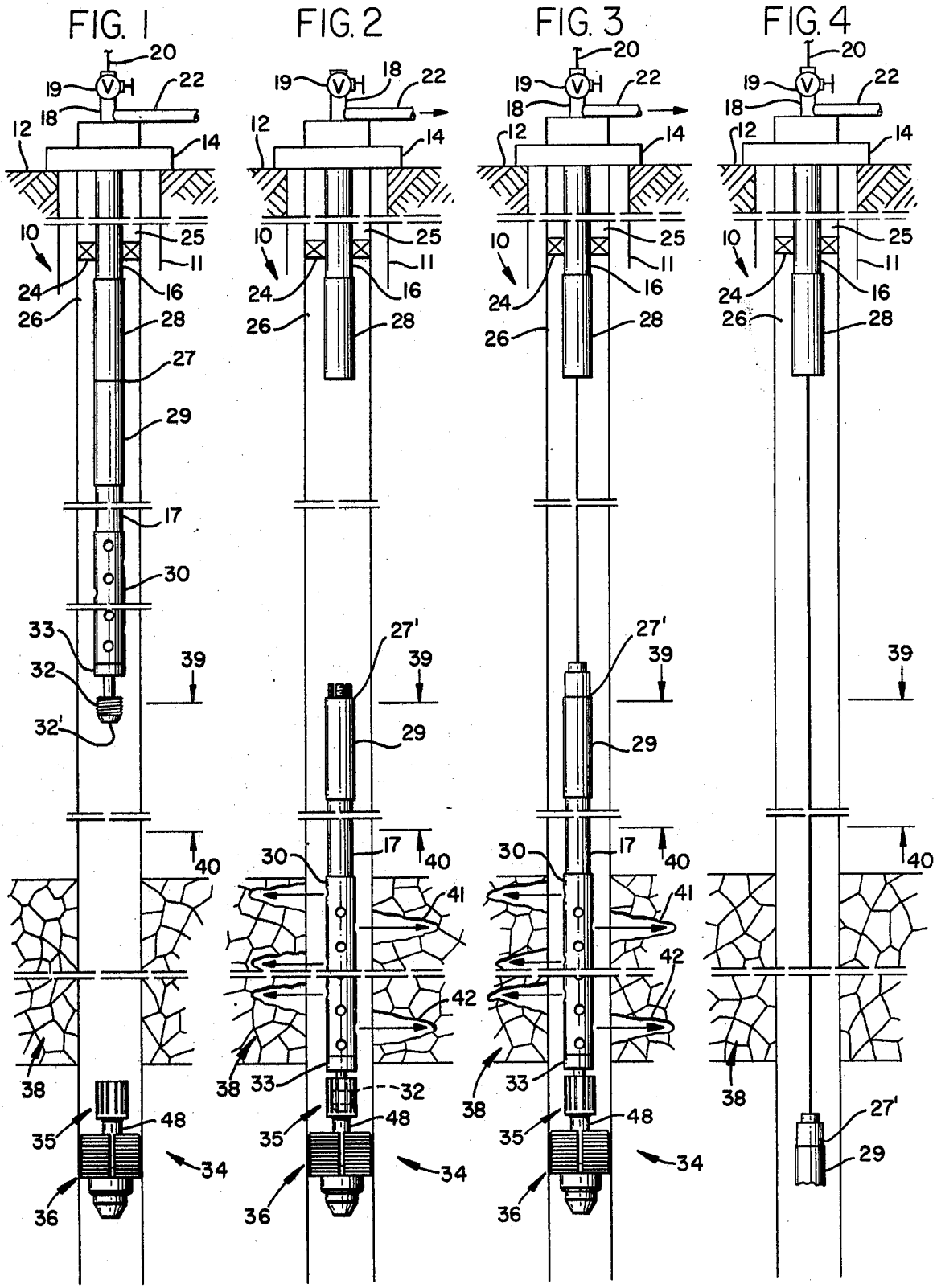
FIG. 1 is a diagrammatical representation of a cross-sectional view of a borehole formed through a strata of the earth having apparatus made in accordance with the present invention disposed therein.
FIG. 2 is similar to FIG. 1 wherein the apparatus of the present invention is disclosed in an alternate operative configuration.
FIG. 3 is similar to FIG. 2 and discloses one of the steps of the method of the present invention.
FIG. 4 is similar to FIG. 3 and discloses the apparatus of the present invention is still another alternate configuration.

Throughout the various figures of the drawings, wherever it is practical or logical to do so, like or similar numerals will usually indicate or refer to like or similar elements.

In the figures of the drawings, a borehole 10 extends through a surface casing 11 and below the surface 12 of the ground. The upper terminal end of the casing is connected to the wellhead 14 in a conventional manner. Production tubing 16 and 17 are series connected and concentrically disposed within the cased borehole. The Christmas tree 18 has the usual lubricator and valve 19 attached thereto so that a wireline 20 can be run downhole into the tubing string, thereby carrying out various downhole operations in a manner understood and appreciated by those skilled in the art. Outflow pipe 22 conducts flow of fluid from the production tubing string.

A packer 24, which can take on any number of different known forms, isolates the upper borehole annulus 25 from the lower borehole annulus 26. A releasable coupling member 27, preferably made in accordance with my U.S. Pat. No. 3,966,236, is comprised of separable members 28 and 29 which can be disengaged from one another by manipulation of a common fishing tool with an ordinary wireline 20, or with uphole tubing pressure, as will be more fully understood later on in this disclosure.

A jet perforating gun 30, made in accordance with my U.S. Pat. No. 3,912,013, is provided with an actuating shaft 32 which causes a firing head 33 to detonate the shaped charges associated therewith upon impact of the actuator with fixed abutment member 34. An anchoring device 36 affixes the abutment member at a predetermined location downhole in the borehole, so that the shaped charges, when detonated, perforate the casing adjacent to a hydrocarbon producing zone 38.

A moderate temperature zone 39 exists uphole in the borehole where temperatures are below the boiling point of water. Further downhole there exists a high temperature zone 40, often in excess of 400° F., wherein ordinary electrical components and explosives associated with jet perforating guns cannot safely endure if permitted to reach equilibrium therein.

In the hypothetical representation of FIG. 5, the temperature decreases at 44 as one penetrates the surface of the earth, where the temperature remains fairly constant at 45, and then begins to increase at a more rapid rate at 45'. The temperature continues increasing at 46 to define the upper limit of the before mentioned moderate temperature zone 39, whereupon the temperature continues to increase as one travels downhole until the before mentioned high temperature zone 40 is encountered. The temperature at 47 is in excess of the upper limit for endurance of the gun components of apparatus 30.

In the claims, the term "relatively low temperature" is intended to define a temperature at which perforating gun components, such as shaped charges, prima cord, blasting caps, and electrical gun circuitry, can endure for several days, whereas the term "relatively high temperature" defines an elevated temperature at which the gun components cannot endure long enough to be run downhole and fired in a conventional manner. Any temperature zone above numeral 39 is a "relatively low temperature zone", while any temperature zone at or downhole of numeral 40 is a "relatively high temperature zone".

The above mentioned references disclose the details of the before mentioned wireline actuated, releasable coupling member 27. The coupling member comprises the before mentioned separable upper and lower members 28 and 29 which are series connected into the tubing string. Upper member 28 has an upper box end portion threadedly engaged with tubing 16, and further includes a terminal lower edge portion at 27.

Lower member 29 has a lowermost edge portion in the form of a pin which threadedly engages tubing 17. The upper edge portion of member 29 is engageable by several known wireline operated fishing tools so that the member can be engaged and forced to move axially in an up or downhole direction. Those skilled in the art know several different fishing tools which are suitable for this purpose, and therefore, the details thereof will be omitted.

The arresting means 34 is disclosed in greater detail in FIG. 6. A mandrel 48 forces anchor 36 into the sidewalls of the casing. Upper abutment 35 is in the form of an upwardly opening skirt member. The skirt member is comprised of a plurality of circumferentially arranged, radially disposed, upwardly directed, parallel fingers 50, having a free end 52 spaced from an attached end 49. The fingers each have opposed sides 54, 56 formed by milling a slot 60 therein. The interior surface of 35 is provided with a threaded surface 58 made complementary with the threaded surface 32. Accordingly, relatively small force is required for member 32 to be received within member 35 with face 32' being abuttingly received against face 51, with the co-acting threads at 32 and 58 threadedly engaging one another so that the members will not part from one another.

In the embodiment set forth in FIGS. 9 and 10, members 28 and 29 are fabricated in accordance with my co-pending patent application Ser. No. 691,384, filed June 1, 1976, wherein the upper marginal end of member 29 is releasably attached to the lower marginal end of member 28 by the illustrated threaded radial fingers 74. The threads on the radial fingers are forced toward the threads on member 28 by means of plug 70. Plug 70 includes a pair of O-rings 72 which prevents inadvertent movement thereof until fluid pressure is effected from uphole. As best seen in FIG. 10, the fingers include lands 74 and cutouts 76, the specific details of which are more clearly set forth in the above mentioned co-pending patent application.

OPERATION

In operation, apparatus 35 is attached to a wireline settable tubing anchor 36. The tubing anchor is run downhole and set at a location so that when the gun 30 subsequently impacts against arrestor 35, the jet charges of the gun will be at the precise elevation desired for formation of the perforations 41 and 42.

Anchor 36 preferably is of a design which can be attached to a wireline and run downhole to its desired location, whereupon the tool is wireline set and thereafter will move neither uphole nor downhole until it is again manipulated by the wireline.

Several different forms of tool 36 are commercially available which are released every other pickup; that is, when the wireline fishing tool is attached as indicated in FIG. 3 and the entire parted lower string picked up, the tool will not release until the wireline has been slacked off and again picked up, thereupon anchor 36 is released until the tool is again set. One form of this tool is described in the Harold Brown Co. Catalog, page 7, as the Brown Model A Tubing Stop. Otis Engineering of Dallas, Tex. also markets a suitable tool for this purpose.

After the arresting device has been set downhole, gun 30 is assembled and attached to the tubing 17. Releasable coupling members 28 and 29 are properly assembled and interposed between marginal tubing lengths 16 and 17. Packer 24 is placed uphole of the releasable coupling, thereby preventing flow between annulus 25 and 26.

After the packer 24 has been set at the desired depth such that the gun 30 is located at a relatively low temperature zone, the well head is assembled to provide a lubricator so that a wireline 20 can be subsequently run down through the tubing string while the well is on production.

The borehole is left in the configuration of FIG. 1 until such time as it is desired to complete the well, whereupon a wireline 20 is run downhole, through the upper tubing string, and into the releasable coupling. A fishing tool engages and releases members 28 and 29, thereby dropping the suspended gun apparatus so that the gun falls downhole from said low to said high temperature zone and impacts against said abutment means in the manner of FIG. 2.

The lower end of the gun is latched to the abutment means upon impact therebetween, and the arresting force resulting from the impact of the gun against the abutment means detonates the charges of the gun.

The latch means by which the gun is latched to the abutment means preferably is the positive latch means disclosed in FIGS. 6 and 8. As the member 32 strikes the abutment means, face 32' abuttingly engages face 51, thereby driving member 32 in an upward direction to cause detonation of the gun.

The threaded, complementary surfaces of members 32 and 35 prevent parting of the gun and the arresting device. As soon as the gun has detonated, production immediately occurs from the formation 38 up the borehole, through the releasable coupling member 28, up through the production tubing 16, and to the Christmas tree, where production continues through outflow pipe 22. Accordingly, the instant the jet perforating charges perforate the wall of the wellbore, the formation is free to flow so that the well is cleaned up in a superior manner and contamination is avoided, as taught in my above mentioned patents.

After the well has been cleaned up, a wireline can be run downhole in the manner of FIG. 3. A fishing tool engages the upper end 27' of coupling member 29 so that member 29 is lifted and manipulated to release anchor 36 from the borehole wall, thereby enabling the lower tool string; which includes the abutment means, gun, and coupling; to be repositioned further downhole in the borehole.

I claim:

1. The method of completing a hydrocarbon containing formation located within a high temperature zone which underlies a relatively low temperature zone comprising the steps of:

1. suspending a perforating gun apparatus within said low temperature zone of said borehole;
2. placing an abutment means downhole within said high temperature zone of said borehole and in close proximity of said hydrocarbon containing formation for arresting said gun when the gun is dropped;
3. dropping the suspended gun apparatus so that the gun falls downhole from said low to said high temperature zone and impacts against said abutment means;
4. latching said gun to said abutment upon impact therebetween; and,
5. detonating said gun means by using the arresting force resulting from impact of said gun against said abutment means.

2. The method of claim 1, and further including the step of engaging said gun apparatus and abutment means with a wireline actuated fishing tool and lowering the gun apparatus to the bottom of the borehole.

3. The method of claim 1 wherein said gun is run into the borehole on the end of a tubing string; and, said dropping of the gun is carried out by the following steps:

placing a wireline actuated, releasable coupling apparatus in the tubing string;

actuating the releasable coupling with a wireline fishing tool so that the coupling is parted and the gun is dropped downhole into engagement with said abutment.

4. The method of claim 3 and further including the step of :

placing a packer device uphole of said releasable coupling to divide the annulus between the tubing and wellbore into an upper and lower annular area so that when the well is completed, production must flow uphole and into the tubing string.

5. The method of claim 1 and further including the step of placing a packer on the end of a tubing string and connecting the gun to the packer so that the gun is located uphole in the borehole in the low temperature region thereof.

6. The method of claim 5 and further including the step of connecting the gun to the packer by a tubing string having a releasable coupling series connected therein; and, actuating the releasable coupling with a wireline actuated fishing tool.

7. The method of claim 5 and further including the step of connecting the gun to the packer by a tubing string having a releasable coupling series connected therein; and, actuating the releasable coupling by fluid pressure.

8. High temperature well completion method comprising:

connecting a detonator to a perforating gun apparatus and arranging the detonator so that it fires the gun upon being suddenly arrested by impact with a downhole obstruction;

locating an obstruction against which said gun can be abuttingly received downhole in a relatively high temperature region of a borehole;

placing a latch means on said gun and abutment so that when said gun is arrested by said abutment, the gun and abutment are affixed together;

releasably locating said perforating gun apparatus uphole in a relatively low temperature region of the borehole;

positioning said gun and obstruction relative to one another and to any hydrocarbon formation which may be contained within said high temperature region so that when the gun impacts the obstruction, the gun can perforate the borehole adjacent the hydrocarbon formation;

releasing said gun apparatus so that it falls from said low to said high temperature region and strikes said abutment, whereupon said detonator fires said gun, causing the borehole to be perforated adjacent the hydrocarbon formation, thereby completing the well.

9. The method of claim 8 wherein said gun is releasably located uphole by telescopingly receiving a marginal length of tubing one within the other and suspending the gun from the tubing;

concentrically positioning a piston in the telescoping portions of the tubing and releasably connecting the telescoping portions of the tubing together by a releasing member which is held into an unreleased position by the piston;

moving the piston downhole by forcing fluid into the upper tubing string, thereby enabling said releasing member to move, and causing the telescoping portions of the tubing to move apart.

10. The method of claim 8 wherein the step of releasing the gun is carried out by connecting the gun to the tubing string by a releasable coupling; and, actuating the releasable coupling with a wireline actuated fishing tool.

11. The method of claim 8 wherein said gun is run into the borehole on the end of a tubing string, and the step of dropping the gun is carried out as follows:

placing a wireline actuated, releasable coupling apparatus in the tubing string; and, actuating the releasable coupling with a wireline fishing tool so that the gun is dropped against said abutment.

12. The method of claim 11 and further including the step of placing a packer device about said releasable coupling so that any production from the completed well must flow uphole and into the tubing string.

* * * * *